United States Patent [19]

Ohmori et al.

[11] Patent Number: 4,653,448

[45] Date of Patent: Mar. 31, 1987

[54] FUEL INJECTION DEVICE

[75] Inventors: Toshihiko Ohmori, Nagoya; Hirotaka Nakatsuka; Hiroyuki Kanou, both of Kariya, all of Japan

[73] Assignee: Nippondenso Co., Ltd., Kariya, Japan

[21] Appl. No.: 702,722

[22] Filed: Feb. 19, 1985

[30] Foreign Application Priority Data

Feb. 22, 1984 [JP] Japan ..... 59-32075

[51] Int. Cl.[4] ..... F02M 39/00

[52] U.S. Cl. ..... 123/446; 123/458; 123/501; 239/88

[58] Field of Search ..... 123/446, 447, 458, 501, 123/500; 239/88–95, 533.2–533.12

[56] References Cited

U.S. PATENT DOCUMENTS

| | | | |
|---|---|---|---|
| 4,378,774 | 4/1983 | Kato | 123/500 |
| 4,385,609 | 5/1983 | Kato | 123/500 |
| 4,425,894 | 1/1984 | Kato | 123/446 |
| 4,485,787 | 12/1984 | Kato | 123/446 |

FOREIGN PATENT DOCUMENTS

| | | | |
|---|---|---|---|
| 0197467 | 11/1983 | Japan | 123/446 |
| 59-96362 | 6/1984 | Japan | 123/500 |
| 2078870 | 1/1982 | United Kingdom | 123/446 |

*Primary Examiner*—Carl Stuart Miller

*Attorney, Agent, or Firm*—Cushman, Darby & Cushman

[57] ABSTRACT

A fuel injection device is disclosed, which includes a body having first and second bores coupled to each other in series. A delivering plunger is fitted in the first bore, so that it can slide, to define a delivering pump chamber therein. Fuel under a constant pressure is supplied to the delivering pump chamber through a control passage, on which an electromagnetic valve is provided for opening and closing it. An injection plunger is fitted in the second bore, so that it can slide, to define in the second bore a chamber linking the delivering pump chamber and an injection pump chamber. Fuel under a pressure lower than the pressure of fuel in the delivering pump chamber is supplied to the injection pump chamber, which is hydraulically coupled to an injection nozzle.

13 Claims, 9 Drawing Figures

DELIVERING PLUNGER

SOLENOID VALVE

INJECTION PLUNGER

SPILL PORT

DRAIN PORT

INJECTION PERIOD

INJECTION RATE

SUCTION PERIOD

FUEL INJECTION DEVICE

BACKGROUND OF THE INVENTION

This invention relates to a fuel injection device for injecting pressurized fuel into a combustion chamber of an internal combustion engine and, more particularly, to a fuel injection device for diesel engines, among internal combustion engines.

As the prior art fuel injection device of the type noted, fuel injection systems are disclosed in U.S. Pat. Nos. 4,378,774, 4,385,609 and Japanese Utility Model Disclosure (KOKAI) No. 59-96362. Any of these well-known known fuel injection systems have an electromagnetic valve for controlling the amount of fuel to be injected. The electromagnetic valve is provided in a fuel supply passage connecting an injection pump chamber and a feed pump for supplying fuel toward the injection pump chamber. The amount of fuel that is led to the injection pump chamber thus can be controlled by controlling the "on" period of the electromagnetic valve, during which the valve is open. In other words, the amount of fuel to be injected can be controlled through control of the operation of the electromagnetic valve according to the engine operation.

Although the prior art fuel injection devices can control the amount of fuel to be injected according to the engine operation, they don't easily control the fuel injection timing according to the engine operation. However, to further improve the engine performance it is necessary to control both of these factors. Therefore, there is a demand for a fuel injection device, which can control the fuel injection timing as well as the amount of fuel to be injected according to the engine operation with an electromagnetic valve.

SUMMARY OF THE INVENTION

An object of the invention is to provide a fuel injection device, which can accurately control the amount of fuel to be injected and the fuel injection timing with the operation of a single electromagnetic valve according to the engine operation.

The above object of the invention is attained by a fuel injection device, which includes a body having a delivering cylinder and an injection cylinder serially coupled thereto. The delivering cylinder defines a first bore extending in its axial direction. A delivering plunger is fitted in the first bore, so that the delivering pump chamber is defined in an end portion of the first bore on the side of the injection cylinder. The injection cylinder defines a second bore in its axial direction. An injection plunger is fitted in the second bore, and it defines in the second bore a linking chamber, which is linked with the end of the delivering pump chamber on the side of the delivering cylinder, and an injection pump chamber remote from the delivering chamber. Fuel under a constant pressure is supplied to the injection pump chamber. A pressurized medium under a pressure higher than the pressure of the fuel supplied to the injection pump chamber is supplied to the delivering pump chamber. An electromagnetic valve is provided in a control passage, through which the pressurized medium is led to the delivering pump chamber, for opening and closing the control passage. The electromagnetic valve is operated according to the operating state of the engine, for which the fuel injection device according to the invention is used. The amount of fuel to be injected and the fuel injection timing thus can be controlled according to the engine operation. The electromagnetic valve is closed while fuel is being supplied to the injection pump chamber, that is, while the delivering plunger and injection plunger are moving in a direction to increase the volumes of the delivering pump chamber and injection pump chamber. When the electromagnetic valve is opened in this state, the pressurized medium is supplied to the delivering pump chamber and also to the linking chamber linked therewith. At this instant, the movement of the injection plunger is stopped, because the pressure of the pressurized medium in the delivering pump chamber and the linking chamber linked therewith, is higher than the pressure of the fuel in the injection pump chamber. At the instant when the movement of the injection plunger stops, the supply of fuel to the injection pump chamber is also discontinued. Thus, only fuel corresponding to the amount to be injected can be supplied to the injection pump chamber by controlling the timing of the operation of the electromagnetic valve according to the engine operation.

The electromagnetic valve is subsequently closed while the delivering plunger is pressurizing the pressurized medium in the delivering pump chamber. The closure of the electromagnetic valve at this time starts the pressurization of the pressurized medium in the delivering pump chamber, i.e., the linking chamber communicated therewith. Thus, subsequent to the closure of the electromagnetic valve the injection plunger is also moved in a direction of pressurizing fuel in the injection pump chamber with the movement of the delivering plunger, so that the fuel in the injection pump chamber is pressurized to a high pressure, by the injection plunger. When the fuel in the injection pump chamber has been pressurized to a pressure in excess of a predetermined injection pressure, it is injected from the injection pump chamber into the engine combustion chamber. The timing of the pressurization of the fuel in the injection pump chamber, i.e., the timing of the fuel injection, thus can be controlled through control of the timing of the closure of the electromagnetic valve according to the engine operation.

The fuel injection device according to the invention thus can accurately control not only the amount of fuel to be injected but also the fuel injection timing through the timing of the operation of the electromagnetic valve according to the engine operation. In addition, the fuel injection device according to the invention can control the amount of fuel to be injected and the fuel injection timing with a single electromagnetic valve, so that it can be simplified in structure and reduced in size.

In a specific effective form of the invention, the electromagnetic valve noted above includes a valve member in the form of a spool which is operated by magnetic force of attraction and receives the pressure in the delivering pump chamber transmitted through the control passage in its radial direction. With this arrangement, the pressure in the delivering pump chamber does not act on the valve member in the axial direction thereof, so that it is possible to reduce the load on the valve member for the operation thereof. It is thus possible to use a small solenoid for the electromagnetic valve, thus permitting a reduction in both the weight and size of the fuel injection device according to the invention.

DETAILED DESCRIPTION OF THE PREFERRED EMBODIMENTS

Figure 1:
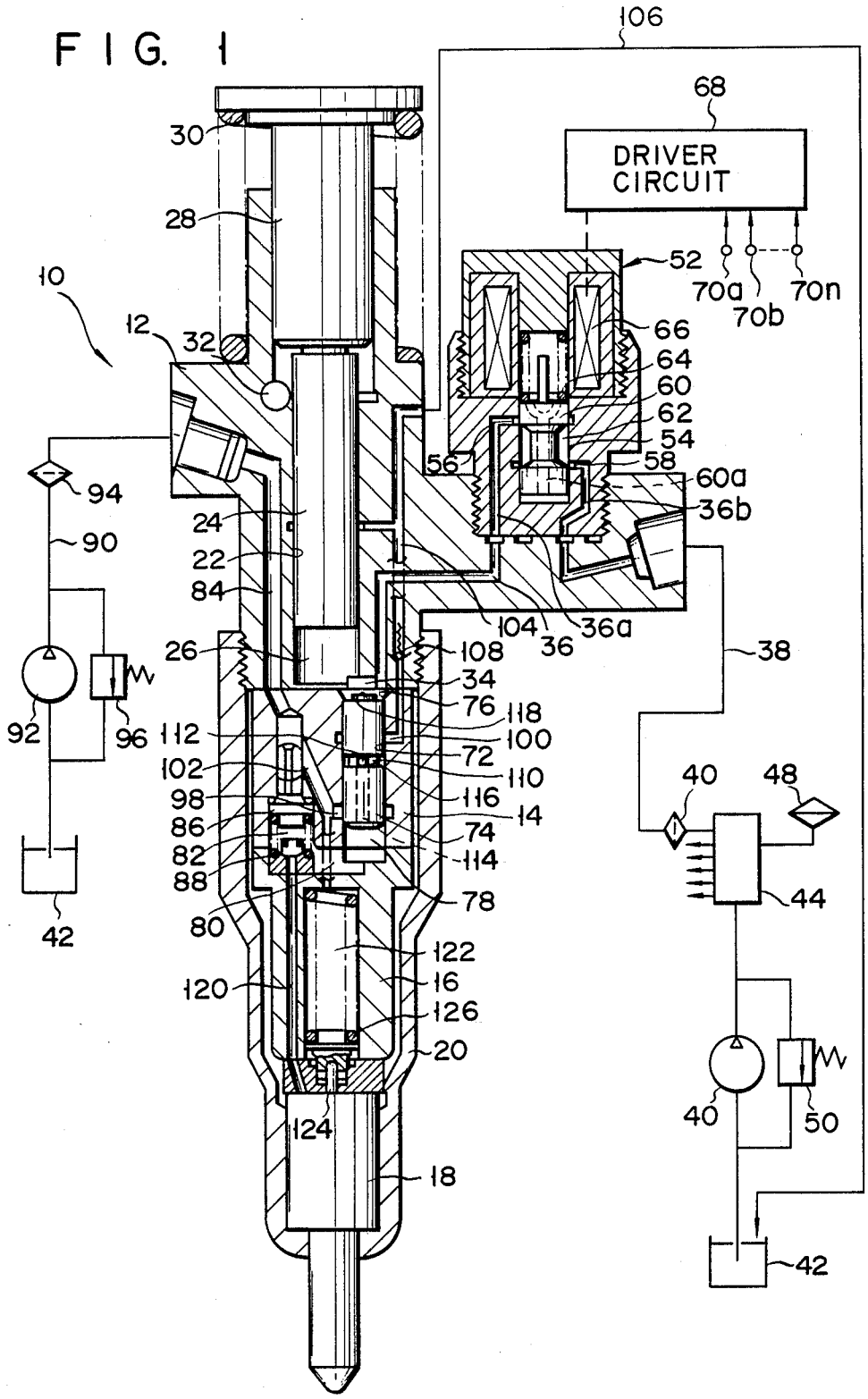
FIG. 1 is a sectional view of an embodiment of the invention.

Referring to FIG. 1, there is shown an embodiment of the fuel injection device according to the invention. The illustrated fuel injection device has a body 10. The body 10 includes a delivering cylinder 12, an injection cylinder 14 and a nozzle holder 16, these components being coaxially integrated end to end in the order mentioned above in FIG. 1. An injection nozzle 18 is coaxially provided at the lower end of the nozzle holder 16. The components 12, 14, 16 and 18 are coupled together by a holder nut 20. More specifically, the holder nut 20 accommodates the injection cylinder 14, nozzle holder 16 and injection nozzle 18 and is screwed onto a threaded lower end portion of the delivering cylinder 12.

The deliverying cylinder 12 has a first bore, formed coaxially as a blind bore in it. A delivering plunger 24 is fitted into the first bore 22. A delivering pump chamber 26 is defined in the first bore 22 by the lower end face of the delivering plunger 24.

The upper end of the delivering plunger 24 is coupled to a cam follower 28, which is fitted into the first bore 22 and the delivering cylinder 24. The cam follower 28 and delivering plunger 24 are upwardly biased by a return spring 30, which is provided between the upper end of the cam follower 28 and the delivering cylinder 12. The cam follower 28 is moved downwards by a cam (not shown), which is rotated in synchronism to the engine, either directly or via a rocker arm against the biasing force of the return spring 30. In other words, the delivering cylinder 24 is reciprocated in synchronism to the engine. The delivering cylinder 12 has a passage 32 which is linked with the first bore 22. The passage 32 is provided for the purposes of supplying a lubricant to the first bore 22 and also purging the air in the first bore 22.

A feed port 34 is open at the lower end of the delivering pump chamber 26. The feed port 34 is linked with a control passage 36 which is formed in the delivering cylinder 12. The control passage 36 is linked with a first feed pump 40 via a feed passage 38. The suction side of the first feed pump 40 is linked with a fuel tank 42. A surge tank 44 and a filter 46 are provided on the feed passage 38. The surge tank 44 is linked with an accumulator 48. A first regulator valve 50 is provided on a relief passage linking the delivery side and the suction side of the first feed pump 40. Fuel that is regulated to a constant pressure by the first regulator valve 50 is supplied from the first feed pump 40 to the surge tank 44. The pressure of the fuel supplied to the surge tank 44 is stabilized by the surge tank 44 and accumulator 48 before the fuel is supplied to the control passage 36.

An electromagnetic valve 52 is screwed into the deliverying cylinder 12 for opening and closing the control passage 36. The electromagnetic valve 52 has a cylinder bore 54. It also has a pair of internal passages **36*a* and 36*b* which constitute part of the control passage 36. The internal passages 36*a* and 36*b* link with respective annular grooves or ports 56 and 58 formed on the inner surface of the cylinder bore 54. A valve member 60 in the form of a spool is slid into the cylinder bore 54. The valve member 60 has an annular groove 62 formed on the outer periphery, and it is downwardly biased by a valve spring 64. As is obvious from FIG. 1, the annular port 56 is closed by the valve member 60. In this state, the internal passages 36*a* and 36*b* are not linked to each other, that is, the control passage 36 is closed. When a solenoid 66 of the electromagnetic valve 52, in the state noted, is energized, the valve member 60 is moved by the solenoid 60 against the biasing force of the valve spring 64 to open the annular port 56. As a result, the internal passages 36*a* and 36*b* are linked with each other, that is, the control passage 36 is opened. The valve member 60 has an axial see-through bore 60*a***.

The energization of the solenoid 66 of the electromagnetic valve 52 is controlled by a driver circuit 68. More specifically, the driver circuit 68 controls the operation of the electromagnetic valve 52 in a manner as described below according to signals from sensors **70*a* to 70*n*** which measure the rotational speed of the engine, the extent of depression of an accelerator pedal, the temperature of the cooling water, etc.

The injection cylinder 14 has a second bore 72 which is eccentric with respect to and smaller in diameter than the first bore 22. The second bore 72 penetrates the injection cylinder 14 and extends into an upper end portion of the nozzle holder 16. An injection plunger 74 is fitted into the second bore 72. It is to be noted that the injection plunger 74 is smaller in diameter than the delivering plunger 24. The injection plunger 74 and second bore 72 define a linking chamber 76, which is linked with the delivering pump chamber 26 via the feed port 34, and an injection pump chamber 78 on the side nearer the nozzle holder 16.

An upper portion of the nozzle holder 16 is formed with a metering hole 80, which is linked with the lower end of the injection pump chamber 78. The metering hole 80 is linked with a check valve chamber 82, which is formed in the nozzle holder 16 and injection cylinder 14. The check valve chamber 82 is linked with a fuel control passage 84, which is formed in the injection cylinder 14 and delivering cylinder 12. The fuel control passage 84 is open at the outer periphery of the delivering cylinder 12. A check valve member 86 is accommodated in the check valve chamber 82. The check valve member 86 is biased by a valve spring 88 to close the fuel control passage 84. The fuel control passage 84 is linked with a second feed pump 92 via a fuel passage 90. The second feed pump 92, like the first feed pump 40, has its section side linked with the fuel tank 42. A filter 94 is provided on the fuel passage 90, and a second regulator valve 96 is provided on a passage linking the delivery side and suction side of the second feed pump 92. The set load of the second regulator valve 96 is less than that of the first regulator valve 50.

An annular spill groove or port 98 and an annular drain groove or port 100 are formed in the mentioned order from below in the inner periphery of the second bore 72. The spill port 98 is linked with the fuel control passage 84 via a spill passage 102. The drain port 104 is linked with the fuel tank 42 via a drain passage 104 and a return passage 106, the drain passage 104 being formed in the injection cylinder 14 and delivering cylinder 12. A check valve 108 is provided in the drain passage 104.

The injection plunger 74 has an annular groove formed in its axially central portion. It also has a radial hole linked with the annular groove 110 and with an axial bore 114 linking the radial hole 112 and injection pump chamber 78. The lower edge of the annular groove 110 serves as a spill lead 116 for opening and closing the spill port 98, and the upper edge of the injection plunger 74 serves as a drain lead 118 for opening and closing the drain port 100.

The check valve chamber 82 is linked with the interior of the injection nozzle 18 via a delivery passage 120 formed in the nozzle holder 16. The nozzle holder 16 has a spring chamber 122. A valve spring 126 is accommodated in the spring chamber 122 so that a needle valve 124 (only an upper end portion thereof being shown) of the injection nozzle 18 is biased by it to close an injection hole (not shown).

The operation of the fuel injection device having the above construction will now be described with reference to FIGS. 2A to 2H.

Figure 2A:
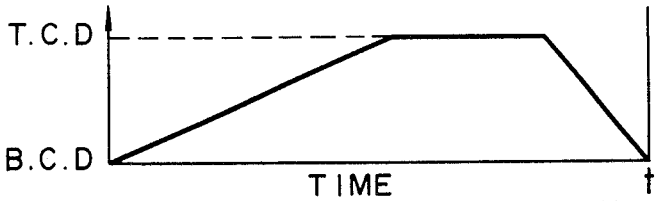
FIGS. 2A to 2H are views showing timings for explaining the operation of the embodiment of the fuel injection device according to the invention.
Figure 2B:
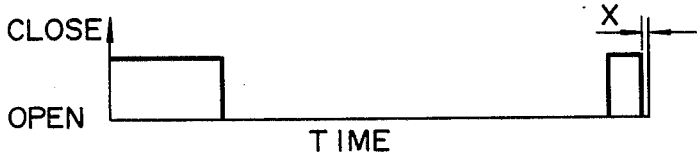

During an upward stroke of the delivering plunger 24 from the bottom dead center, the control passage 36 is held closed by the electromagnetic valve 52, as shown in FIGS. 2A and 2B. In this state, the pressure in the delivering pump chamber 26 is decreasing. With the rise of the delivering plunger 24, therefore, the injection plunger 74 is also raised. Consequently, the pressure in the injection pump chamber 78 is also decreasing. Thus, fuel is supplied under a constant pressure determined by the second regulator valve 96 from the second feed pump 92 through the fuel control passage 84, check valves 86 and 82 and metering hole 80 to the injection pump chamber 78. In this intake stroke, the electromagnetic valve 52 is fully opened, as shown in FIG. 2B, whereupon fuel forced out from the first feed pump 40 and regulated by the first regulator valve 50 is supplied through the control passage 36 and feed hole 34 to the delivering pump chamber 26. The pressure in the delivering pump chamber 26 becomes higher than the pressure in the injection pump chamber 78 because the set load of the first regulator valve 50 is greater than that of the second regulator valve 96. Consequently, the lift of the injection plunger 74 is stopped, and the supply of fuel to the injection pump chamber 78 is discontinued at the same time. More specifically, referring to FIGS. 2B and 2H, the intake stroke, in which fuel is supplied to the injection pump 78, is ended as soon as the electromagnetic valve 52 is opened, whereby the injection plunger 74 is lifted to a position corresponding to the quantity of fuel filling the injection pump chamber 78. The fuel filling the injection pump chamber 78 thus can be controlled by controlling the timing of the opening of the electromagnetic valve 52. The timing of the opening of the electromagnetic valve 52 is controlled according to the engine operation.

It is to be appreciated that the delivering plunger 24 continues to lift until it reaches top dead center, even if the lift of the injection plunger 74 has stopped, and fuel is supplied to the delivering pump chamber 26 until the delivering plunger 24 reaches top dead center.

As the delivering plunger 24 subsequently falls from top dead center, as shown in FIG. 2A, the fuel in the delivering pump chamber 26 escapes through the feed port 34 and control passage 36 to the first feed pump 40 because the electromagnetic valve 52 is open at this time. In this state, the fuel in the delivering pump 26 is not yet pressurized, and the injection plunger 74 remains stationary.

Figure 2C:
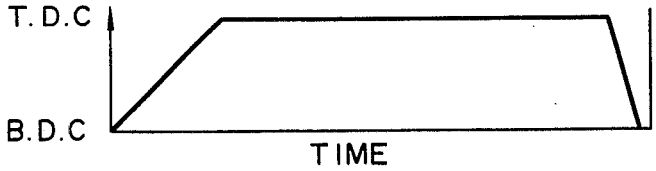
Figure 2D:
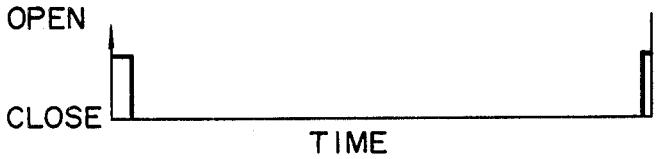

When the electromagnetic valve 52 is thereafter closed, the fuel in the delivering pump chamber 26 can no longer escape. It is only after this that the fuel in the delivering pump chamber 26 and linking chamber 76 is pressurized. Therefore, the injection plunger 74 starts to fall, as shown in FIG. 2C, thus pressurizing the fuel in the injection pump chamber 78. The injection plunger 74 falls faster than the delivering plunger 24 for its diameter is smaller than the diameter of the delivering plunger 24.

When the pressure of fuel in the injection pump chamber 78 that is being pressurized with the descent of the injection plunger 74 exceeds the set pressure of the injection nozzle 18 that is determined by the valve spring 126, the fuel in the injection pump chamber 78 is delivered through the metering hole 80, check valve 82 and delivery passage 120 to the injection nozzle 18 and injected through the injection hole thereof into the combustion chamber of the engine.

It is to be noted that the pressurization of fuel in the delivering pump chamber 26, and the injection pump chamber 78, is started the instant the electromagnetic valve 52 is closed. The fuel injection start timing thus can be controlled by controlling the timing of the closing of the electromagnetic valve 52. The timing of the closing of the electromagnetic valve 52 is controlled according to the engine operation as noted above.

With the descent of the delivering plunger 24, the injection plunger 74 is lowered further, as shown in FIG. 2B. As a result, the spill 98 is opened by the spill lead 116 of the injection plunger 74. At this time, the fuel under high pressure in the injection pump chamber 78 escapes through the axial bore 114, radial hole 112, annular groove 110, spill port 98 and spill passage 102 to the fuel control passage 84. Thus, the pressure of the fuel in the injection pump chamber 78 is quickly reduced to bring an end to the injection of fuel.

Figure 2E:
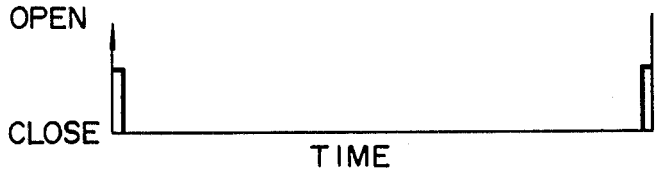
Figure 2F:
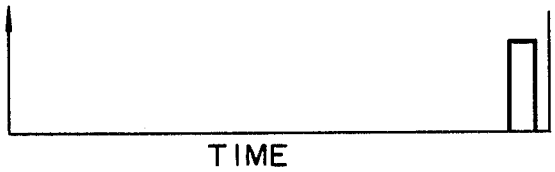
Figure 2G:
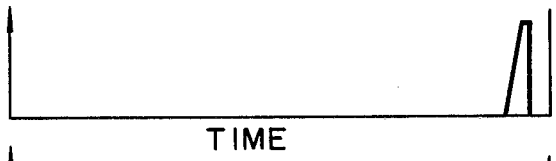
Figure 2H:
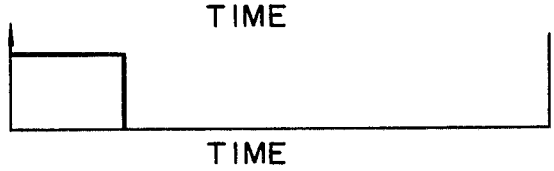

The injection plunger 74 is continually lowered with the descent of the delivering plunger 24, and the drain port 100 is eventually opened by the drain lead 118 of the injection plunger 78, as shown in FIG. 2E. The fuel in the delivering pump chamber 26 is thus returned through the linking chamber 76, drain port 100, drain passage 104, check valve 108 and return passage 106 to the fuel tank 42. At this instant, the descent of the injection plunger 74 is stopped, stopping the fuel injection period as shown in FIG. 2F. The delivering plunger 24 is still lowered after the descent of the injection plunger 74 has stopped, as shown in FIG. 2A. At this time, the electromagnetic valve 52 is opened, whereby the fuel in the delivering pump chamber 26 can escape not only to the fuel control passage 84 but also to the control passage 36. Subsequently, the delivering plunger reaches bottom dead center and stops.

With such a fuel injection device, it is possible to control not only the amount of fuel injected but also the timing of the start of fuel injection through the control of the operation of the single electromagnetic valve 52 according to the engine operation.

Further, with the fuel injection device according to the invention, when the electromagnetic valve 52 is closed, the pressure of the fuel in the delivering pump chamber 26 acts on the valve member 60 of the electromagnetic valve 52 in the radial direction thereof but not in the axial direction thereof. This means that the biasing force of the valve spring 64 and magnetic force of attraction of the solenoid may be small for the operation of the electromagnetic valve 52. Thus, the size of the electromagnetic valve 52 can be effectively reduced, and the breakdown strength thereof may be low.

Further, with the fuel injection device according to the invention, the injection cylinder 14 is constructed separately to the delivering cylinder 12, constituting the body 10. Thus, the cylinders 12 and 14 may be small in size, and the bores, passages and holes may be readily formed in them.

The embodiments of the invention as described above are by no means limited. For example, while in the above embodiment the electromagnetic valve 52 is opened once during a period after the end of the fuel injection period and till the start of the fuel intake period, as shown at x in FIG. 2B, the electromagnetic valve 52 may remain closed during the period x as well. In this case, the number of times the electromagnetic valve 52 is operated in one cycle of the fuel injection device may be reduced.

What is claimed is:

1. A fuel injection device for injecting fuel into a combustion chamber of an internal combustion engine, comprising:

a body having first and second bores formed therein and extending in the axial direction thereof;

a delivering plunger fitted into the first bore and defining a delivering pump chamber therein;

driving means for reciprocating the delivering plunger in synchronism to the engine;

pressurized medium supplying means for supplying a pressurized medium under a constant pressure to the delivering pump chamber, the pressurized medium supplying means including a pressurized medium source and a control passage linking the pressurized medium source to the delivering pump chamber;

an electromagnetic valve provided on the control passage for opening and closing the control passage;

an injection plunger fitted into the second bore and defining, in the second bore, a linking chamber communicating with the delivering pump chamber and an injection pump chamber, the linking chamber and the delivering chamber becoming a liquid-tight chamber when the electromagnetic valve closes the control passage, and said injection plunger being so moved as to enable the volume of the injection chamber to increase by a pressure decrease in the liquid-tight chamber when said delivery plunger is moved to increase the volume of the delivering pump chamber to thereby increase the volume of the liquid-tight chamber in the state where said electromagnetic valve is kept closed;

fuel supplying means for supplying fuel pressurized to a constant pressure to the injection pump chamber, the pressure of the pressurized fuel being set to be lower than the pressure of the pressurized medium; and an injection nozzle hydraulically coupled to the injection pump chamber, the injection nozzle injecting pressurized fuel into the combustion chamber of the engine when the fuel in the injection pump chamber is pressurized to a pressure above a constant pressure.

2. The fuel injection device according to claim 1, wherein the body includes a delivering cylinder in which the first bore is defined, and an injection cylinder in which the second bore is defined.

3. The fuel injection device according to claim 2, wherein the first and second bores are coupled to each other in series.

4. The fuel injection device according to claim 1, wherein the injection plunger is smaller in diameter than the delivering plunger.

5. The fuel injection device according to claim 1, wherein the pressurized medium source of the pressurized medium supplying means includes:

a pressurized medium tank;

a first feed pump for withdrawing and forcing out the pressurized medium in the pressurized medium tank;

a surge tank provided on the delivery side of the first feed pump;

an accumulator coupled to the surge tank; and a first regulator valve provided on a passage linking the delivery side and suction side of the first feed pump for regulating the pressure of the pressurized medium forced out from the first feed pump.

6. The fuel injection device according to claim 5, wherein the pressurized medium in the pressurized medium tank is fuel.

7. The fuel injection device according to claim 1, wherein the fuel supplying means includes:

a second feed pump for supplying fuel; and a second regulator valve provided on a passage linking the delivery side and suction side of the second feed pump for regulating the pressure of fuel forced out from the second feed pump.

8. The fuel injection device according to claim 1, wherein the electromagnetic valve includes:

a valve body having a cylinder bore extending perpendicular to and crossing the control passage;

a valve member in the form of a spool fitted in said cylinder bore so that it can slide for opening and closing the control passage;

spring means for urging the valve member in the axial direction thereof; and a solenoid for moving the valve member by magnetic force of attraction against the biasing force of the spring means.

9. The fuel injection device according to claim 8, wherein the electromagnetic valve is normally in a position closing the control passage and is switched to a position opening the control passage when the solenoid is energized.

10. The fuel injection device according to claim 1, wherein the control passage communicates with both the delivering pump chamber and the linking chamber.

11. The fuel injection device according to claim 1, further comprising escape means for allowing the high-pressure fuel to escape from the injection pump chamber to a region having a pressure lower than that of the injection pump chamber at an escape time when the volume of the injection pump chamber becomes smaller than a predetermined value due to the movement of said injection plunger.

12. The fuel injection device according to claim 11, wherein said escape means includes an annular groove formed in the outer circumferential surface of said injection plunger, a communication path for allowing communication between the annular groove and the injection pump chamber, and an escape passage having one end opened to the inner circumferential surface of the second bore and capable of communicating with the annular groove of said injection plunger at said escape time, and the other end connected to the lower pressure region.

13. The fuel injection device according to claim 12, wherein said fuel supply means includes a fuel passage connected to the injection pump chamber, and said other end of the escape passage communicates with the fuel passage.

* * * * *